US012365996B2

(12) United States Patent
Hammad et al.

(10) Patent No.: US 12,365,996 B2
(45) Date of Patent: Jul. 22, 2025

(54) ELECTROCHEMICAL CONVERSION OF CARBON DIOXIDE

(71) Applicant: Saudi Arabian Oil Company, Dhahran (SA)

(72) Inventors: Ahmad D. Hammad, Dhahran (SA); Issam T. Amr, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 517 days.

(21) Appl. No.: 17/684,891

(22) Filed: Mar. 2, 2022

(65) Prior Publication Data

US 2022/0282385 A1 Sep. 8, 2022

(30) Foreign Application Priority Data

Mar. 4, 2021 (GR) ..... 20210100132

(51) Int. Cl.

| | |
|---|---|
| ***C25B 3/29*** | (2021.01) |
| ***C25B 1/23*** | (2021.01) |
| ***C25B 3/03*** | (2021.01) |
| ***C25B 3/07*** | (2021.01) |
| ***C25B 9/19*** | (2021.01) |
| ***C25B 9/70*** | (2021.01) |

(52) U.S. Cl.

CPC ..... *C25B 3/295* (2021.01); *C25B 1/23* (2021.01); *C25B 3/03* (2021.01); *C25B 3/07* (2021.01); *C25B 9/19* (2021.01); *C25B 9/70* (2021.01)

(58) Field of Classification Search

CPC .. C25B 3/295; C25B 3/25; C25B 3/26; C25B 1/23; C25B 3/03; C25B 3/07

See application file for complete search history.

(56) References Cited

U.S. PATENT DOCUMENTS

| | | | |
|---|---|---|---|
| 3,288,692 | A | 11/1966 | Leduc |
| 3,427,235 | A | 2/1969 | Leduc |
| 3,585,217 | A | 6/1971 | Titzenthaler |
| 3,632,497 | A | 1/1972 | Leduc |
| 3,894,059 | A | 7/1975 | Selvaratnam |
| 4,119,507 | A | 10/1978 | Simmrock et al. |

(Continued)

FOREIGN PATENT DOCUMENTS

| | | |
|---|---|---|
| WO | WO 2015139136 | 9/2015 |
| WO | WO 2018107450 | 6/2018 |

OTHER PUBLICATIONS

Bidrawn et al., "Efficient Reduction of CO2 in a Solid Oxide Electrolyzer," Electrochemical and Solid-State Letters, II, 2008, 9:B167-B170, 6 pages.

(Continued)

*Primary Examiner* — Ciel P Contreras

(74) *Attorney, Agent, or Firm* — Fish & Richardson P.C.

(57) ABSTRACT

A system and method for feeding carbon dioxide to a first cathode cavity of a first electrochemical cell, electrochemically reducing the carbon dioxide at a first cathode in the first electrochemical cell to carbon monoxide (CO), flowing the CO from the first cathode cavity to a second cathode cavity of a second electrochemical cell, and forming at least one of ethanol or ethylene from the CO at a second cathode in the second electrochemical cell. The forming of the at least one of ethanol or ethylene from the CO may involve dimerization of the CO at the second cathode to form CO dimer.

10 Claims, 3 Drawing Sheets

(56) References Cited

U.S. PATENT DOCUMENTS

| | | | |
|---|---|---|---|
| 4,329,208 | A | 5/1982 | Vayenas et al. |
| 4,434,031 | A | 2/1984 | Horowitz et al. |
| 4,560,451 | A | 12/1985 | Nielsen |
| 4,602,986 | A | 7/1986 | Ellis et al. |
| 4,609,441 | A | 9/1986 | Frese, Jr. et al. |
| 4,761,394 | A | 8/1988 | Lauritzen |
| 5,527,436 | A | 6/1996 | Cooker et al. |
| 6,336,791 | B1 | 1/2002 | O'Toole |
| 7,704,369 | B2 | 4/2010 | Olah et al. |
| 7,951,283 | B2 | 5/2011 | Stoots et al. |
| 8,075,746 | B2 | 12/2011 | Hartvigsen et al. |
| 8,138,380 | B2 | 3/2012 | Olah et al. |
| 8,592,633 | B2 | 11/2013 | Cole et al. |
| 8,845,875 | B2 | 9/2014 | Teamey et al. |
| 8,845,878 | B2 | 9/2014 | Cole et al. |
| 9,012,345 | B2 | 4/2015 | Masel et al. |
| 9,115,070 | B2 | 8/2015 | Pazicky et al. |
| 9,175,409 | B2 | 11/2015 | Sivasankar et al. |
| 9,260,366 | B2 | 2/2016 | Verhaak et al. |
| 9,273,020 | B2 | 3/2016 | Schjodt et al. |
| 9,555,367 | B2 | 1/2017 | Masel et al. |
| 10,329,676 | B2 | 6/2019 | Kaczur et al. |
| 10,676,833 | B2 | 6/2020 | Dismukes et al. |
| 11,001,549 | B1 | 5/2021 | Hammad et al. |
| 2011/0132770 | A1 | 6/2011 | Sala et al. |
| 2013/0134049 | A1 | 5/2013 | Teamey et al. |
| 2015/0057458 | A1 | 2/2015 | Schjodt et al. |
| 2017/0292197 | A1 | 10/2017 | Lei et al. |
| 2017/0314148 | A1 | 11/2017 | Rondinone et al. |
| 2018/0023202 | A1 | 1/2018 | Krause et al. |
| 2019/0032228 | A1 | 1/2019 | Krause et al. |
| 2021/0079537 | A1* | 3/2021 | Spurgeon ..... C25B 3/25 |
| 2021/0140056 | A1* | 5/2021 | Jiao ..... C25B 9/19 |
| 2021/0171430 | A1 | 6/2021 | Hammad et al. |
| 2021/0179526 | A1 | 6/2021 | Hammad et al. |
| 2024/0044021 | A1* | 2/2024 | Ozden ..... C25B 11/032 |

OTHER PUBLICATIONS

Luo et al., "Facet Dependence of CO2 Reduction Paths on Cu Electrodes," ACS Catalysis, Nov. 2015, 6(1):219-229, 36 pages.

Ni et al., "Modeling of solid oxide electrolysis cell for carbon dioxide electrolysis," Chemical Engineering Journal, 2010, 164:246-254, 9 pages.

Ou et al., "A New Reduction Mechanism of CO Dimer by Hydrogenation into C2H4 on Cu(100) Surface: A Theoretical Insight into Kinetics of Elementary Steps," RSC Advances, Oct. 2015, 5:96281-96289, 9 pages.

* cited by examiner

100

300

ELECTROCHEMICAL CONVERSION OF CARBON DIOXIDE

CROSS-REFERENCE TO RELATED PATENT APPLICATIONS

This application claims the benefit of priority to Greek Application No. 20210100132, filed on Mar. 4, 2021, the entire contents of which are incorporated by reference herein.

TECHNICAL FIELD

This disclosure relates to electrochemical conversion of carbon dioxide into chemicals.

BACKGROUND

Carbon dioxide is the primary greenhouse gas emitted through human activities. Carbon dioxide ($CO_2$) may be generated in various industrial and chemical plant facilities. At such facilities, the utilization of $CO_2$ as a feedstock may reduce CO2 emissions at the facility and therefore decrease the $CO_2$ footprint of the facility. The conversion of the greenhouse gas $CO_2$ into value-added feedstocks or products may be beneficial.

SUMMARY

An aspect relates to a method including feeding carbon dioxide to a first cathode cavity of a first electrochemical cell, electrochemically reducing the carbon dioxide at a first cathode in the first electrochemical cell to carbon monoxide (CO), flowing the CO from the first cathode cavity to a second cathode cavity of a second electrochemical cell, and forming at least one of ethanol or ethylene from the CO at a second cathode in the second electrochemical cell.

Another aspect relates to a method including feeding carbon dioxide to a first cathode cavity of a first electrochemical cell of an electrochemical two-cell apparatus, and electrochemically reducing the carbon dioxide at a first cathode in the first electrochemical cell to carbon monoxide (CO), wherein electrochemically reducing the carbon dioxide generates oxygen ions. The method includes flowing the CO from the first cathode cavity to a second cathode cavity of a second electrochemical cell of the electrochemical two-cell apparatus, and forming a product including at least one of ethanol or ethylene from the CO via a catalyst at a second cathode in the second electrochemical cell.

Yet another aspect relates to a system including an electrochemical two-cell apparatus to electrochemically reduce carbon dioxide into carbon monoxide at a first cathode and convert the carbon monoxide into at least one of ethanol or ethylene at a second cathode. The electrochemical two-cell apparatus includes a first electrochemical cell including a first cathode cavity, the first cathode, a first catalyst disposed along the first cathode, a first anode, a first electrolyte to conduct oxygen ions from the first cathode to the first anode, and a first anode cavity to collect and discharge oxygen gas formed from the oxygen ions. The electrochemical apparatus includes a second electrochemical cell including a second cathode cavity to receive the carbon monoxide from the first cathode cavity, the second cathode, a second catalyst disposed along the second cathode, a second anode to generate hydrogen ions, a second anode cavity, a second electrolyte disposed between the second anode and the second cathode to diffuse the hydrogen ions from the second anode to the second cathode, wherein the second electrolyte is a proton conductor. The system includes a first conduit to supply the carbon dioxide to the first cathode cavity, and a second conduit to discharge the at least one of ethanol or ethylene from the second cathode cavity.

Yet another aspect relates to an electrochemical two-cell apparatus including a first electrochemical cell including a first cathode cavity to receive carbon dioxide, a first cathode to electrochemically reduce the carbon dioxide into carbon monoxide and generate oxygen ions, a first anode to receive the oxygen ions, a first anode cavity to collect and discharge oxygen gas formed from the oxygen ions, a first electrolyte disposed between the first cathode and the first anode to conduct the oxygen ions, and a first catalyst disposed along the first cathode. The electrochemical two-cell apparatus includes a second electrochemical cell including a second cathode cavity to receive the carbon monoxide, a second cathode to convert the carbon monoxide into at least one of ethanol or ethylene, a second anode to generate hydrogen ions, a second anode cavity, a second electrolyte to diffuse the hydrogen ions from the second anode to the second cathode, and a second catalyst disposed along the second cathode.

The details of one or more implementations are set forth in the accompanying drawings and the description below. Other features and advantages will be apparent from the description and drawings, and from the claims.

DETAILED DESCRIPTION

Some aspects of the present disclosure are directed to electrochemical conversion of carbon dioxide ($CO_2$) into chemicals that have value, such as ethanol, ethylene, etc. A multi-cell (e.g., two-cell) arrangement may be employed for conversion (e.g., direct conversion) of $CO_2$ into ethanol or ethylene. The setup may include two connected electrochemical cells, where $CO_2$ is reduced on the cathode of the first cell to carbon monoxide (CO). This CO may go through dimerization and hydrogenation on the second cell to produce ethanol and/or ethylene.

The research community and industry are progressively converging to a conclusion that $CO_2$ sequestration has limitations for the value proposition. Alternatively, creating diverse demand markets and revenue streams for the recovered almost-pure $CO_2$ may prevail over $CO_2$ sequestration options and improve the economic feasibility of this mitigation approach for climate change. As such, research in the carbon capture and management field is seen to be shifting towards $CO_2$ utilization, directly and indirectly, in energy and chemical industries.

Electrochemical reduction of $CO_2$ to value-added chemicals and fuels offers a potential platform to store renewable energy in chemical bonds and thus a route to carbon recycling. Among many possible reaction pathways, and due to relatively high efficiency and reasonable economic feasibility, $CO_2$ conversion to CO can be an action in the synthesis of more complex carbon-based fuels and feedstocks, and may hold significance for the chemical industry.

Embodiments herein produce hydrocarbons (e.g. ethanol, ethylene, etc.) through the electrochemical reduction of $CO_2$. This $CO_2$ conversion may be implemented in a two-cell setup (dual cell arrangement) of electrochemical cells including, for instance, in which the two cells are coupled to one another and may share a housing.

Figure 1:
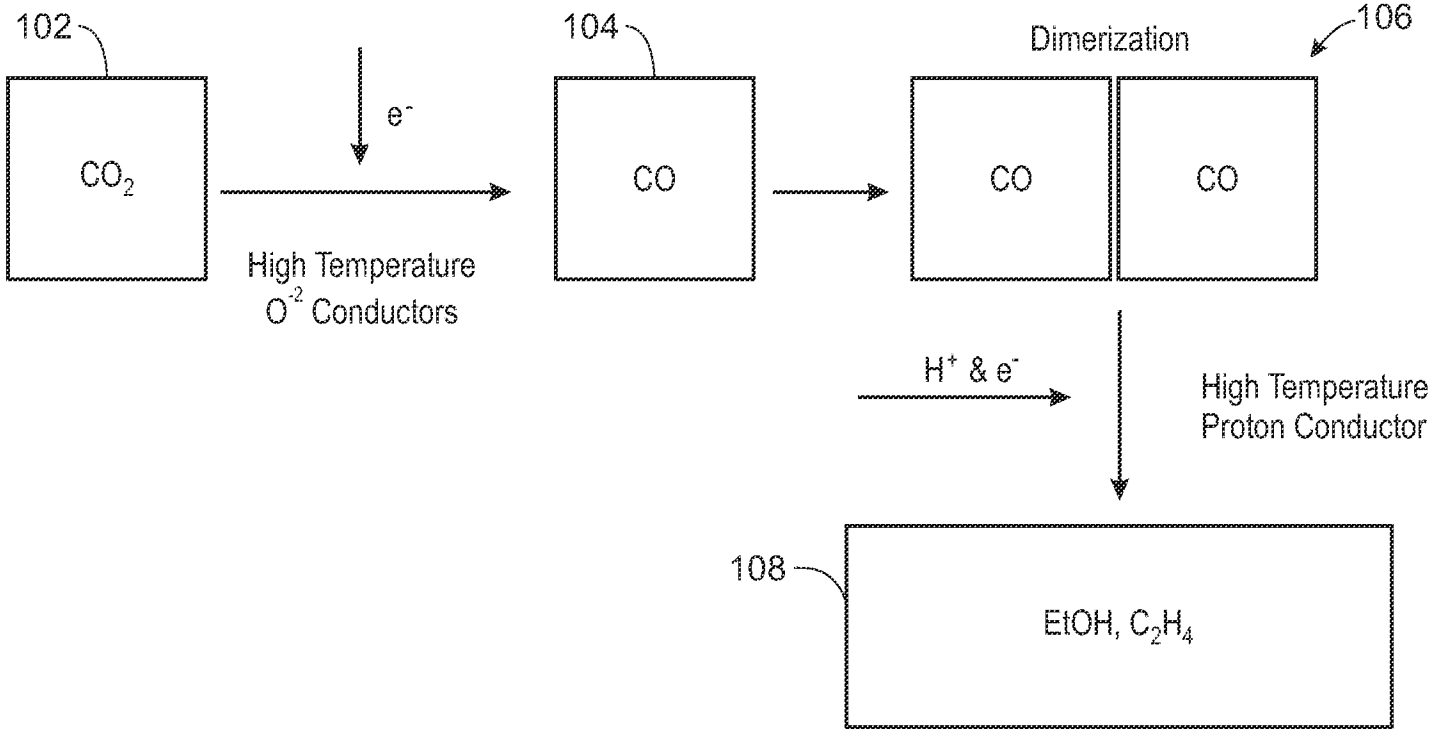
FIG. 1 is a diagram of a technique to convert carbon dioxide in an electrochemical two-cell arrangement or apparatus.

FIG. 1 is a technique 100 to convert $CO_2$ 102 in an electrochemical two-cell arrangement or apparatus. The $CO_2$ 102 is electrochemically reduced into CO 104 via electrons at the cathode of the first electrochemical cell. Oxygen ($O^{-2}$) ions flows from the cathode through an electrolyte (high-temperature $O^{-2}$ conductor) to the anode.

At the cathode of the second electrochemical cell, the CO 104 undergoes dimerization via electrocatalyst to give CO dimer 106 (OCCO or OCCO*) that is hydrogenated via $H^+$ ions into compounds 108. The CO dimerization may be via electrochemical reduction. Electrochemical reduction or the electrons may be involved in the dimerization of CO. The compounds 108 may be, for example, ethanol (EtOH) or ethylene (C2H4). The hydrogenation may be electrochemical hydrogenation. Electrochemical reduction or electrons may be involved in the hydrogenation of the CO dimer. The $H^+$ ions flow from the anode through an electrolyte (proton conductor) to the cathode. This electrolyte may be a high-temperature proton conductor and/or low-temperature proton conductor. The $H^+$ ions may hydrogenate the CO dimer directly from the cathode. The intermediate OCCO* may be hydrogenated by the $H^+$ ions. The $H^+$ ions may form $H_2$ gas in the cathode side cavity for the hydrogenation of the CO dimer. The asterisk (*) notation for dimer OCCO* means that the dimer is an excimer (excited dimer) that can be temporary or short-lived.

In summary, the electrochemical two-cell setup or apparatus may be utilized for $CO_2$ conversion to ethanol and/or ethylene through CO dimerization. Therefore, embodiments may enhance $CO_2$ utilization by electrochemically reducing $CO_2$ into CO and then the CO dimerized and converted to ethanol and/or ethylene. The $CO_2$ conversion may be characterized as a direct conversion in at least the sense that the conversion of $CO_2$ to ethanol or ethylene occurs within the arrangement of two coupled electrochemical cells. The sequence may be the reduction of $CO_2$ to CO, followed by the dimerization of the CO, and then hydrogenation of the CO dimer to ethanol and/or ethylene. These actions in the sequence may occur simultaneously in a continuous operation of the two coupled electrochemical cells.

Figure 2:
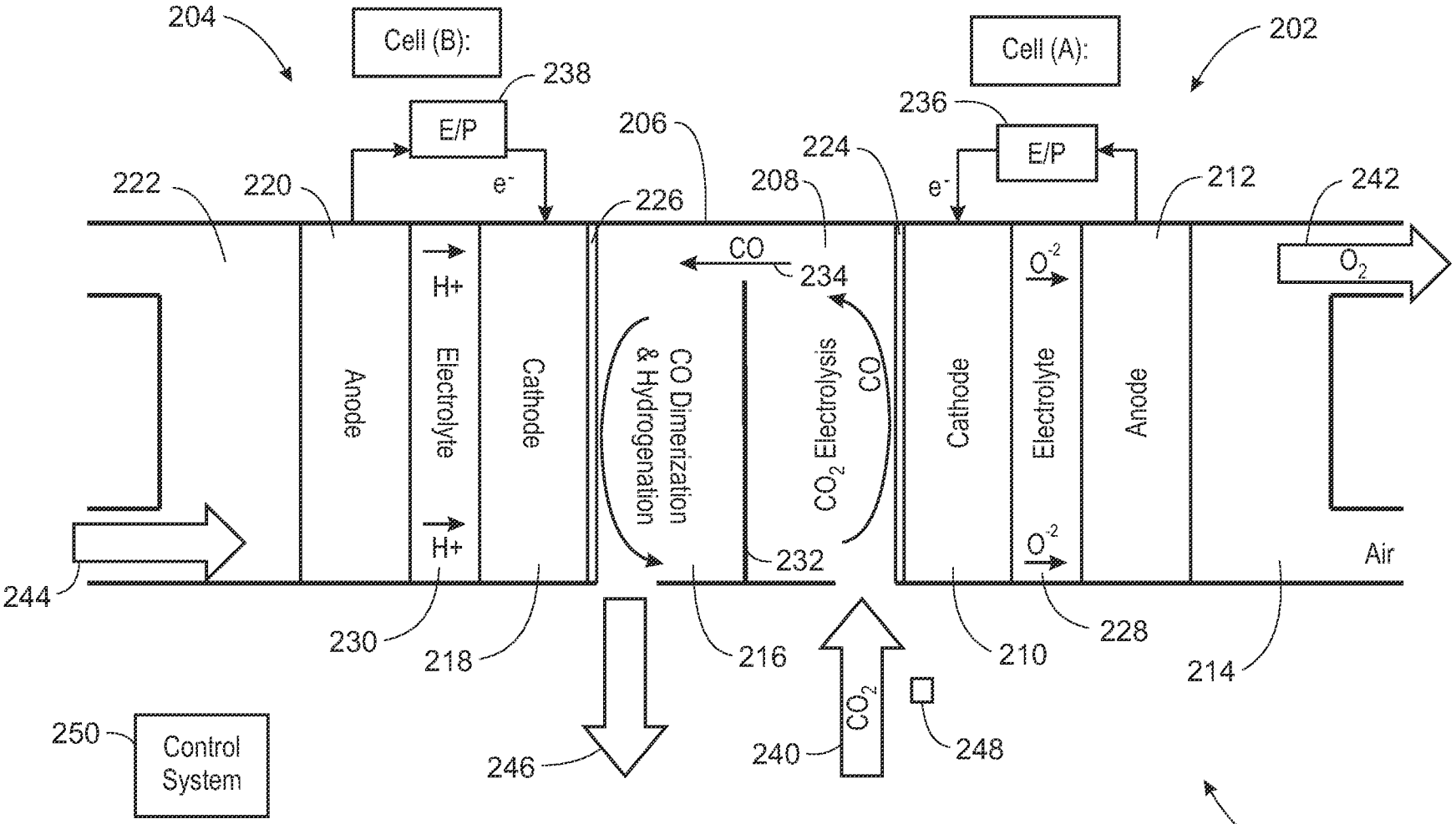
FIG. 2 is a diagram of a system 200 having an electrochemical two-cell apparatus.

FIG. 2 is a system 200 having an electrochemical two-cell apparatus 201 that can be labeled as an electrochemical two-cell device. The electrochemical two-cell apparatus 201 includes a first electrochemical cell 202 (labeled as cell (A)) and a second electrochemical cell 204 (labeled as cell (B)) that are coupled. In the illustrated embodiment, the electrochemical cells 202, 204 share a housing 206. The housing 206 may be, for example, metal such as stainless steel. In other embodiments, the two cells 202, 204 do not share a housing but are otherwise fluidically coupled (e.g., via a conduit), for example, on the cathode sides.

The first cell 202 has a cathode cavity 208, a cathode 210, an anode 212, and an anode cavity 214. Likewise, the second cell 204 has a cathode cavity 216, a cathode 218, an anode 220, and an anode cavity 222.

The cathodes 210, 218 and the anodes 212, 220 as electrodes may each be a ceramic or metal (or metal oxide). An example metallurgy is a nickel alloy to give nickel-based electrodes. The cathodes 210, 218 and the anodes 212, 220 may be electrodes based on ceramic materials that exhibit stability through reduction-oxidation (redox) cycles, electrocatalytic activity and mixed ionic/electronic conductivity in reducing atmospheres are applicable. In implementations, the electrode material may be ceramic oxides of perovskite structure. Other materials are applicable.

Respective catalyst 224, 226 (e.g., electrocatalyst) may be disposed along the cathodes 210, 218 in the cathode cavities 208, 216. In examples for the first cell 202, the catalyst 224 (first catalyst) in the cathode cavity 208 may be coated on the surface of the cathode 210. Likewise, in examples for the second cell 204, the catalyst 226 (second catalyst) in the cathode cavity 216 may be coated on the surface of the cathode 218.

The first catalyst 224 (e.g., electrocatalyst) associated with the cathode 210 for the reduction of $CO_2$ may be, for example, metals, metal oxides, tetrahedral oxide structures, or ceramic oxides of perovskite structure and alloys. The first catalyst 224 may include, for example, $Li_2MSiO_4$ (LMS), $Li_2CoSiO_4$ (LCS), $Li_2NiSiO_4$ (LNS), $LiNi_{1-X-Y}Co_XMn_YO_2$, (La,Sr)$CoO_3$ (LSC) with different La—Sr ratios, $La_{1-x}SrxCr_{1-y}M_yO_3$ (M=Mn, Fe, Co, Ni), (La,Sr)(Fe,Co)$O_3$ (LSCF), (Sm,Sr)$CoO_3$ (SSC), and (Ba,Sr)(Co,Fe)$O_3$ (BSCF).

The second catalyst 226 (e.g., electrocatalyst) associated with the cathode 218 for the CO dimerization may be a metal or metal oxide. In some examples, the second catalyst 224 is copper (Cu) or includes copper. The metal catalyst may have a specified facet cut. The facets may be, for example, (111), (110), or (100), which are Miller indices. The principal difference between (111), (110), and (100) facets in materials may be the surface energy. Each facet can have a characteristic surface energy with the value depending, for example, on the number of broken chemical bonds in the surface.

The catalyst metal and facet may be specified to promote the CO dimerization. In examples, the facet specified for the catalyst metal is (100). In one example, the catalyst 224 is Cu(100) catalyst, which is copper catalyst having a cut at (100) facet. This Cu(100) catalyst [copper (100) facet] has been utilized, for instance, in the production of methanol and can be utilized for CO dimerization to CO dimer 2CO. The dimer mechanism may take place on the Cu(100) surface followed by hydrogenation of the CO dimer to ethylene or ethanol.

The anodes 212, 220 may be an electrocatalytic anode or an electrocatalyst may be employed at the anodes 212, 220. An example of electrocatalyst for the anodes 212, 220 is silver (Ag) and Ag-containing materials. Other materials for an electrocatalyst (if employed) at the anodes 212, 220 are applicable.

The first electrochemical cell 202 has an electrolyte 228 (first electrolyte) disposed between the cathode 210 and the anode 212. Likewise, the second chemical cell 204 has an electrolyte 230 (second electrolyte) disposed between the cathode 218 and the anode 220. The electrolytes 228, 230 may be a solid electrolyte. The solid electrolyte may be a solid oxide or ceramic, or other material, for the high-temperature regime. The solid electrolyte may be a polymer, or other material, for the low-temperature regime. In implementations, the first cell 202 or the second cell 204, or both, may be a solid oxide electrolysis cell (SOEC) or a reversible polymer electrolyte membrane fuel cell (R-PEM).

The electrolyte 228 of the first cell 202 may be a high-temperature $O^{-2}$ conductor that conducts $O^{-2}$ ions. The first electrolyte 228 may be, for example, yttria-stabilized zirconia (YSZ), cerium (IV) oxide ($CeO_2$), or other material that conducts $O^{-2}$ ions. The YSZ material if employed may be prepared by doping yttrium oxide ($Y_2O_3$) into zirconium dioxide ($ZrO_2$). In one example, the electrolyte 228 is $Y_2O_3$-stabilized $ZrO_2$ (YSZ) having at least 6 mole percent (mol %) $Y_2O_3$ or at least 8 mol % $Y_2O_3$.

The electrolyte 230 of the second electrochemical cell 204 may be a high-temperature proton conductor that conducts $H^+$ ions. The second electrolyte 230 material may be, for example, material of the perovskite family that conducts $H^+$ ions. The second electrolyte 230 may be other material that conducts $H^+$ ions. In some examples, the second electrolyte 230 is $SrCe_{0.95}Yb_{0.05}O_3$ or $CaIn_{0.1}Zr_{0.9}O_{3-\alpha}$, where Sr is strontium, Ce is Cerium, Yb is Ytterbium, O is elemental oxygen, Ca is calcium, In is indium, and Zr is zirconium. Also, the second electrolyte 230 material may be polymer electrolyte membrane. In one example, the second electrolyte 230 is a sulfonated tetrafluoroethylene (a sulfonated tetrafluoroethylene-based fluoropolymer-copolymer), such as Nafion® commercially available from DuPont de Nemours, Inc. having headquarters in Wilmington, Delaware USA.

In the illustrated embodiment, the first cell 202 and the second cell 204 share the housing 206, and with the first cathode cavity 208 and the second cathode cavity 216 sharing a space in the housing 206. The first cathode cavity 208 is a portion (about half) of the space that is adjacent to the first cathode 210. The second cathode cavity 216 is a portion (about half) of the space that is adjacent the second cathode 218. A partial barrier 232 in the shared space generally divides the first cathode cavity 208 and the second cathode cavity 216. The partial barrier 232 allows for flow of gas (e.g., CO 234) from the first cathode cavity 208 to the second cathode cavity 216. In other embodiments, there is no partial barrier 232. Instead, the CO 234 formed by the electrochemical reduction of carbon dioxide at the first cathode 210 flows from the first cathode cavity 210 to the second cavity 216 (and second cathode 218) without a partial barrier between the cavities 210, 216. In yet other embodiments, the first cell 202 and the second cell 204 have separate housings and the cavities 210, 216 do not share a space. Instead, the first cathode cavity 208 is fluidically coupled to the second cathode cavity 216 via a conduit, such as metal tubing (e.g., stainless steel), for flow of gas (e.g., CO 234).

In implementations, the electrochemical cells 202, 204 share the partial barrier 232 (e.g., stainless steel plate) as depicted positioned to divide the cathode cavity 208 of the first cell 202 from the cathode cavity 216 of the second cell 204. The partial barrier 232 may be a metal plate (e.g., stainless steel) as a solid wall. The partial barrier 232 has a gap or opening to allow for flow of gas (e.g., CO 234) from the cathode cavity 208 of the first cell 202 to the cathode cavity 216 of the second cell 204.

A power source 236 supplies electric current (electrons) to the cathode 210 of the first cell 202 for the electrochemical reduction of $CO_2$ into CO to occur. A power source 238 supplies electric current (electrons) to the cathode 218 of the second cell 202 for the dimerization of CO and hydrogenation of the CO dimer into ethanol or ethylene. In implementations, the first power source 236 and the second power source 238 may be the same power source. The power source 236, 238 may be a battery, a power generator, an electrical grid, a renewable source of power, etc. The applied electric current may be modulated or regulated. The desired amount of current (or set point of the amount of current supplied) may be determine correlative with reaction requirements at the cathodes 210, 218 or anodes 212, 220. In implementations, the amount of current input may be based at least in part on the oxidation reaction requirement at the anode 110. The amount of current supplied by the power source 236, 238 may be modulated via a variable resistor or potentiometer, or by varying voltage, and the like. The amount of current supplied by the power source 236, 238 may be modulated (adjusted and maintained) via a controller directing or including the variable resistor or potentiometer, or directing the varying of the voltage, and the like.

While only one dual-cell arrangement (one electrochemical two-cell apparatus) is depicted for clarity, more than one dual-cell arrangement (more than one electrochemical two-cell apparatus) may be employed. The system 200 may include an electrochemical cell stack having multiple dual-cells (multiple electrochemical two-cell apparatuses) operationally in parallel.

Operating conditions for the electrochemical two-cell apparatus as a dual-cell arrangement (two-cell setup) may include an operating pressure at less than 2 bar gauge (barg). The operating temperature may be, for example, in the range of 500° C. and 950° C. (or 700° C. to 900° C.) for the high-temperature regime. The operating temperature may be, for example, in the range of 25° C. to 200° C. for the low-temperature regime associated with the second cell 204.

In operation, $CO_2$ 240 is fed via a supply conduit to the cathode cavity 208 of the first electrochemical cell 202. In certain embodiments, the $CO_2$ 240 stream fed to the cathode cavity 208 may be primarily $CO_2$, such as greater than 50 volume percent (vol %) $CO_2$, greater than 80 vol % $CO_2$, or greater than 90 wt % $CO_2$. The housing 206 has an inlet to receive the $CO_2$ 240 into the cathode cavity 208 adjacent the cathode 210 and catalyst 224. The inlets and outlets of the electrochemical two-cell apparatus including for the cathode cavities 208, 216 and anode cavities 214, 222 may be formed through the housing 206.

In operation, the $CO_2$ 240 is electrochemically reduced at the cathode 210 into CO via the electrons provided from the power source 236. The CO 234 flows from the first cathode cavity 208 to the second cathode cavity 216. In the reduction of the $CO_2$ into CO at the cathode 210, $O^{-2}$ ions are generated and diffuse (conduct, migrate, transmit) through the electrolyte 228 to the anode 212. The reaction or half reaction that takes place at the cathode 210 in the cathode cavity 208 may be $CO_2+2e^- \rightarrow CO+O^{-2}$. This reaction or half reaction (electrochemical reduction) is endothermic.

With respect to the $O^{-2}$ ions that diffuse from the cathode 210 through the electrolyte 228 to the anode 212, the half reaction that takes place at the anode 212 side is $2O^{-2} \rightarrow O_2+4e^-$. This reaction is generally exothermic. The anode 212 discharges electrons to the power source 236. The oxygen ($O_2$) gas 242 at the anode 212 side that forms in the anode cavity 214 may discharge through an outlet of the anode cavity 214 into a discharge conduit. The $O_2$ gas can be utilized for different applications. In implementations, a displacement gas (e.g., air) may be provided via a supply conduit through an inlet to the anode cavity 210 to displace the $O_2$ gas 242.

As mentioned, the CO 234 generated via the electrochemical reduction of the $CO_2$ 240 on the cathode 210 side of the first cell 202 flows to the cathode cavity 216 of the second cell 204. On the cathode 218 side of the second cell 204, the CO 234 is dimerized and the resulting CO dimer is hydrogenated into ethanol or ethylene, or both. Half reactions that may take place at the cathode 210 include $2CO+8H^++8e^- \rightarrow C_2H_5OH+H_2O$ and/or $2CO+8H^++8e^- \rightarrow C_2H_4+2H_2O$. The "2CO" notation in these two reactions is the CO dimer. These two half reactions generate water ($H_2O$) in addition to the desired ethanol ($C_2H_5OH$) or ethylene ($C_2H_4$).

To provide $H^+$ ions for the hydrogenation, a stream 244 is fed via a supply conduit through an inlet of the anode cavity 222 into the anode cavity 222. The stream 244 may be or include hydrogen ($H_2$) gas or water ($H_2O$), or both. Thus, the stream 244 may be or include at least one of $H_2$ or $H_2O$.

For the stream 244 being or including hydrogen ($H_2$) gas, $H^+$ ions are generated at the anode 220, for example, per the half reaction $4H_2 \rightarrow 8H^+ + 8e^-$. This half reaction could be expressed as $H_2 \rightarrow 2H^+ + 2e^-$ but the general balance of the system is with respect to 8 electrons. The electrons flow to the power source 238. The $H^+$ ions diffuse from the anode 220 through the electrolyte 230 to the cathode 218 for the hydrogenation in the second cell 202.

For the stream 244 being or including water ($H_2O$) fed to the anode cavity 222 and utilized on the anode 220 as a source of $H^+$ ions, $H^+$ ions may be generated, for example, per the reaction $4H_2O \rightarrow 2O_2 + 8H^+ + 8e^-$. This half reaction could be expressed as $2H_2O \rightarrow O_2 + 4H^+ + 4e^-$ but the general balance of the system is with respect to 8 electrons. The stream 244 may include $H_2O$ in addition to or in lieu of $H_2$.

As indicated, Cu(100) may be utilized as the catalyst 226 in the reduction of CO 234 to OCCO* formed by CO dimerization and followed by hydrogenation into ethanol or ethylene. The first step of forming OCCO* by CO dimerization is generally a more favorable pathway than the further hydrogenation of CO. This explains why only two-carbon (C2) species and generally not single carbon (C1) species are observed experimentally on Cu(100). For the formation of C2H4 or EtOH on Cu(100), the hydrogenation of OCCO* to the OCCHO* intermediate is the most likely reaction path, followed by the formation of intermediate OHCCHO* through further hydrogenation of the OCCHO* intermediate. The formation of OCCO* may be the rate-determining step in the reduction mechanism of the CO dimer.

The product 246 discharges through an outlet from the cathode cavity 216 of the second electrochemical cell 204 into a discharge conduit. The product 246 may include ethanol or ethylene, or both. The product 246 may also include generated $H_2O$, unreacted CO, and unreacted $CO_2$. There may be unreacted $H_2$ in the product 246. The target may be electrochemical hydrogenation via the $H^+$ ions. Yet, the $H^+$ ions could form $H_2$ in the cathode cavity 216 for the hydrogenation. The product 246 discharged may be further processed. The motive force for discharge of the product 246 from the second cathode cavity 216 may be the incoming supply pressure of the $CO_2$ 240 fed to the first cathode cavity 208. The supply pressure of the $CO_2$ 240 may be by an upstream mechanical compressor or by a $CO_2$ supply header pressure, and the like.

A control valve 248 may be disposed along the supply conduit conveying the $CO_2$ 240 to the first cell 202 to modulate (adjust and maintain at set point) the flow rate of the $CO_2$ 240 into the cathode cavity 208 of the first cell 202. The control valve 248 may instead be disposed on the discharge conduit conveying the product 246 discharged from the cathode cavity 216 of the second cell 204. The amount of $CO_2$ 240 fed to the cathode cavity 208 may depend, for example, on the specified production rate of the product 246, which can be affected by the electrochemical two-cell apparatus 201 capacity and other factors. The control valve 248 may be a flow control valve that controls mass rate (mass per time) or volumetric rate (volume per time) of the $CO_2$ 240 stream. The control valve 248 may be a pressure control valve that controls pressure by modulating (adjusting, altering) the flow rate of the $CO_2$ 240 stream or the product 246 stream. For example, pressure may be controlled upstream or downstream of the control valve 248. In one example, the control valve 248 is disposed along the discharge conduit conveying the product 246 and acts as a backpressure regulator to control pressure in the cathode cavities 208, 216. In other examples, an upstream mechanical compressor controls the flow rate of the $CO_2$ 240 stream.

As for supply of the stream 244 as $H_2$, the amount (rate) of $H_2$ 244 fed to the anode cavity 222 of the second cell 204 may be set or modulated (adjusted and maintained) to generate a specified amount (rate) of $H^+$ ions to migrate to the cathode 218. The amount (flow rate) of $H_2$ 244 may be modulated by a control valve (not shown) disposed on the supply conduit conveying the $H_2$ 244 or modulated (adjusted, altered, maintained) by an upstream $H_2$ mechanical compressor, and the like. Similarly, for implementations in which $H_2O$ is fed as the stream 244, the amount (rate) of $H_2O$ fed to the anode cavity 222 of the second cell 204 may be set or modulated (adjusted and maintained) to generate a specified amount (rate) of $H^+$ ions to migrate to the cathode 218. The amount (flow rate) of supplied $H_2O$ may be modulated by a control valve (not shown) disposed on the supply conduit conveying the water or modulated by an upstream $H_2O$ supply pump (e.g., by controlling the speed and/or length of strokes of the pump) or steam mechanical compressor, and the like.

An adequate number of $H^+$ ions are generated at the anode 220 for the hydrogenation on the cathode 218 side. This migration of the $H^+$ ions from anode 220 to the cathode 218 may be affected by the anode 220 material, proton conductivity of the electrolyte 230, and the electrochemical dual-cell operating conditions, such as temperature and applied electric potential by the power source.

The system 200 may include a control system 250 having a processor and memory storing code (e.g., instructions, logic, etc.) executed by the processor. The control system 250 may be or include one or more controllers. The control system 250 may direct operation of the system 200. In certain implementations, the control system 250 or controller regulates the amount of electric current provided to the cathodes 210, 218 from the power source 236, 238. The control system 250, via calculation or user-input, may direct and specify the set point of the control valve 248 and also the control valve on the $H_2$ 244 (or water) supply.

The processor may be one or more processors and each processor may have one or more cores. The hardware processor(s) may include a microprocessor, a central processing unit (CPU), a graphic processing unit (GPU), a controller card, or other circuitry. The memory may include volatile memory (for example, cache and random access memory (RAM)), nonvolatile memory (for example, hard drive, solid-state drive, and read-only memory (ROM)), and firmware. The control system 250 may include a desktop computer, laptop computer, computer server, programmable logic controller (PLC), distributed computing system (DSC), controllers, actuators, or control cards. In operation, the control system 250 may facilitate processes of the system 200 including to direct operation of the electrochemical two-cell system. The control system 250 may receive user input or computer input that specifies the set points of control components in the system 200. The control system 250 may determine, calculate, and specify the set point of control devices. The determination can be based at least in part on the operating conditions of the system 200 including feedback information from sensors and transmitters, and the like.

As can be appreciated, derivation of beneficial or applicable operating conditions (including optimization of operating conditions) can be implemented. Operating conditions can include temperature, pressure, oxygen-to-ethylene ratio, and flow rates, and so forth. In implementations, the oxygen in the oxygen-to-ethylene ratio may include the oxygen ions controlled electrochemically to meet the reaction requirements in the first electrochemical cell 202. The operating conditions may be adjusted to favor production of ethanol or ethylene. Such may include changing the reaction parameters, including the reactant ratios and partial pressures. To force the reaction toward a specific direction (to give ethanol or ethylene) may involve a combination of at least three factors: optimized parameters, catalysis, and electrochemical effect. The dominant influence may be electrochemically because the different intermediate species required specific activation energy and a goal can be to stabilize the ethoxy intermediate. To force the reaction into one direction (ethanol or ethylene) can involve applied electric-potential numerical ranges with a combination of decided parameters.

In implementation, two CO molecules may go through dimerization to form active OCCO*. The following electrochemical hydrogenation steps may produce $CH_2CHO$, which upon further electrochemical hydrogenation may take the two following possible reaction paths:

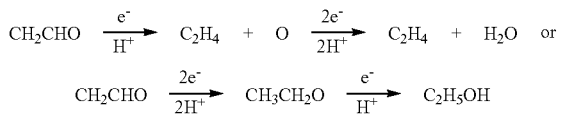

The selection of either of the two paths may be determined electrochemically by controlling the potential, in addition to other parameters such as the catalyst type and cut shape. Surface structure may control the coverage of CO, leading to the reduction of CO dimer to $C_2$ products (ethylene and ethanol) at a voltage range, for example of 0.4V-1.3V versus reversible hydrogen electrode (RHE) as reference electrode. Ethanol may present a plateau peak, for example at potential range [1.0V-1.2V] vs. RHE, while ethylene may present a plateau peak at slightly lower potential (e.g., [0.8V-1.0V]) vs. RHE. This can be changed if the electrocatalyst surface structure and/or composition are changed.

Lastly, the nomenclature of the system 200 may be expressed as follows. The system 200 includes the electrochemical two-cell apparatus 201, supply conduits, discharge conduits, control valve(s), the control system 250, and so on. The electrochemical two-cell apparatus 201 may be characterized as a two-cell setup or a dual cell arrangement. The electrochemical two-cell apparatus 201 includes the first electrochemical cell 202 and the second electrochemical cell 204. The first electrochemical cell 202 includes the first cathode cavity 208, the first cathode 210, the first anode 212, the first anode cavity 214, the first electrolyte 228 disposed between the first cathode 210 and the first anode 212, the first catalyst 224 disposed along the first cathode 210, and so forth. The second electrochemical cell 204 includes the second cathode cavity 216, the second cathode 218, the second anode 220, the second anode cavity 222, the second electrolyte 230 (e.g., proton conductor) disposed between the second cathode 218 and the second anode 220, the second catalyst 226 disposed along the second cathode 218, and the like.

Figure 3:
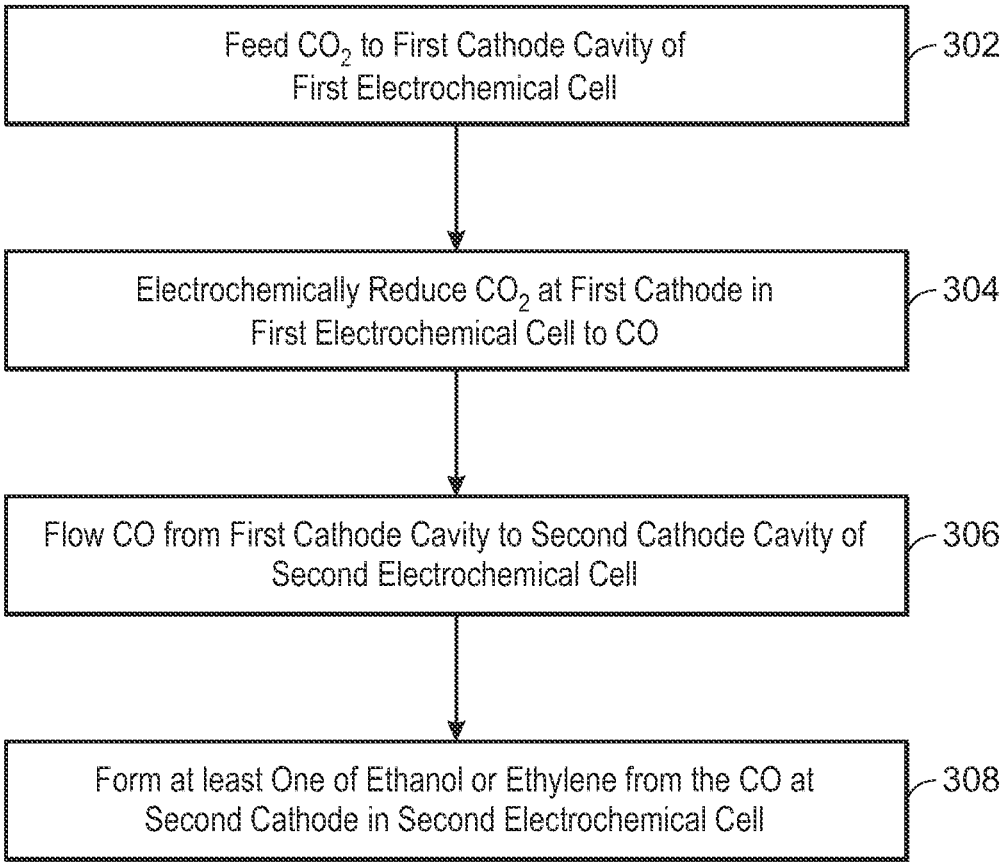
FIG. 3 is a block flow diagram of a method of operating a system including an electrochemical two-cell apparatus.

FIG. 3 is a method 300 of operating a system including an electrochemical multi-cell (e.g., two-cell) apparatus having a first electrochemical cell coupled to a second electrochemical cell. The method 300 may include converting $CO_2$ via the system and producing via the system at least one of ethanol or ethylene.

The first electrochemical cell and the second electrochemical cell may share a housing. The first cathode cavity of the first electrochemical cell and the second cathode cavity of the second electrochemical cell may share a space within the housing. A partial barrier may be disposed in the space. In other implementations, the first electrochemical cell and the second electrochemical cell do not share a housing, and the respective cathode cavities are fluidically coupled, for example, via a conduit.

At block 302, the method includes feeding $CO_2$ to the first cathode cavity of the first electrochemical cell, such as via a supply conduit to the electrochemical two-cell apparatus. An inlet of the first cathode cavity may be coupled to the supply conduit. The inlet may be formed in a housing of the electrochemical two-cell apparatus. The method may include controlling (e.g., via a control valve, upstream mechanical compressor, etc.) the amount of the $CO_2$ gas fed through the supply conduit to the first cathode cavity.

At block 304, the method includes electrochemically reducing the $CO_2$ at the first cathode in the first electrochemical cell to CO, wherein electrochemically reducing the $CO_2$ generates $O^{-2}$ ions. A first catalyst (e.g., electrocatalyst) may be disposed along (e.g., coated on) the first cathode to promote or facilitate the electrochemical reduction of the $CO_2$.

The method may include diffusing the $O^{-2}$ ions generated at the first cathode through a first electrolyte of the first electrochemical cell to a first anode of the first electrochemical cell. Oxygen gas may be formed from the $O^{-2}$ ions and collected in a first anode cavity of the first electrochemical cell. A gas (e.g., air) may be fed to the first anode cavity to discharge the $O_2$ gas from the first anode cavity into a discharge conduit exiting the electrochemical two-cell apparatus. An outlet of the first anode cavity may be coupled to the discharge conduit. The outlet of the first anode cavity may be formed in a housing of the electrochemical two-cell apparatus.

At block 306, the method includes flowing the CO from the first cathode cavity to the second cathode cavity of the second electrochemical cell. As mentioned, the first cathode cavity and the second cathode cavity may be separated by a partial barrier. The flowing of the CO from the first cathode cavity to the second cathode cavity may involve flowing the CO past the aforementioned partial barrier separating the first cathode cavity from the second cathode cavity. The CO may flow through a gap or opening in the partial barrier. In other implementations, the electrical two-cell apparatus does not include the partial barrier. Instead, the flowing of the CO from the first cathode cavity to the second cathode cavity involves the CO flowing from the region adjacent the first cathode to the region adjacent the second cathode (of the second electrochemical cell) without an intervening barrier or partial barrier in the space that forms the first cathode cavity and the second cathode cavity. In yet other implementations, the flowing of the CO from the first cathode cavity to the second cathode cavity involves flowing the CO through a conduit.

At block 308, the method includes forming at the second cathode (e.g., including via a second catalyst) at least one of ethanol or ethylene from the CO. The forming of the at least one of ethanol or ethylene from the CO may involve dimerization of the CO at the second cathode to form CO dimer, and hydrogenating the CO dimer at the second cathode. The dimerization and the hydrogenating may be performed via the second catalyst (e.g., electrocatalyst) at the second cathode.

Thus, the method may include forming a product having the at least one of ethanol or ethylene from the CO via the second catalyst at the second cathode. Again, the forming of the product may involve at the second cathode the dimerization of the CO into CO dimer and hydrogenation of the CO dimer into the at least one of ethanol or ethylene. The method may include discharging the product from the second cathode cavity into a discharge conduit external to the electrochemical two-cell apparatus.

The hydrogenating may involve hydrogenating the CO dimer at the second cathode via $H^+$ ions diffused through a second electrolyte (e.g., proton conductor) of the second electrochemical cell from the second anode of the second electrochemical cell. The method may include feeding $H_2$ gas or water to the second anode cavity of the second electrochemical cell and generating the $H^+$ ions from the $H_2$ gas or water at the second anode.

The second catalyst may promote or facilitate, at the second cathode, dimerization of the CO into CO dimer and hydrogenation of the CO dimer via the $H^+$ ions into the at least one of ethanol or ethylene. In implementations, the electrocatalyst includes Cu(100) catalyst that is copper having a facet cut of (100).

There may be advantages of utilizing the second electrochemical cell to form via electrolysis the CO dimer and to rely on $H^+$ ions from the second anode through the second electrolyte for the hydrogenation. First, renewable energy may be utilized to activate the reaction. Second, water can be utilized on the second anode as a source of $H^+$ ions, for example, per the reaction $2H_2O \rightarrow O_2+4H^++4e^-$. Third, the second cell facilitates to electrochemically control the selectivity toward the production of ethylene and ethanol, whereas in contrast the direct hydrogenation without electrolysis may go to primarily methane.

In conclusion, embodiments provide a setup for direct electrocatalytic conversion of $CO_2$ into CO and then to hydrocarbons including ethanol or ethylene. The two-cell setup for may provide for the simultaneous: (1) $CO_2$ reduction, (2) followed by CO dimerization, and (3) conversion to ethanol and/or ethylene by hydrogenation. The techniques can enhance $CO_2$ utilization as feedstock, reduce $CO_2$ footprint, and provide for valorization into higher-value commodity chemicals.

An embodiment is a method including feeding carbon dioxide to a first cathode cavity of a first electrochemical cell, electrochemically reducing the carbon dioxide at a first cathode in the first electrochemical cell to CO, flowing the CO from the first cathode cavity to a second cathode cavity of a second electrochemical cell, and forming at least one of ethanol or ethylene from the CO at a second cathode in the second electrochemical cell. The forming the at least one of ethanol or ethylene from the CO may involve dimerization of the CO at the second cathode to form CO dimer. The forming of the at least one of ethanol or ethylene from the CO may involve hydrogenating the CO dimer at the second cathode. The hydrogenating may involve hydrogenating the CO dimer at the second cathode via $H^+$ ions diffused through an electrolyte (proton conductor) of the second electrochemical cell from an anode of the second electrochemical cell. The method may include feeding hydrogen gas or water to an anode cavity of the second electrochemical cell, and generating the $H^+$ ions from the hydrogen gas or water at the anode. The dimerization and the hydrogenating may be performed via an electrocatalyst at the second cathode. The electrocatalyst may be, for example, Cu(100) catalyst that is copper having a facet cut of (100). The first electrochemical cell and the second electrochemical cell may share a housing. The flowing of the CO from the first cathode cavity to the second cathode cavity may involve flowing the CO past a partial barrier separating the first cathode cavity from the second cathode cavity. The first electrochemical cell and the second electrochemical cell may form an electrochemical two-cell apparatus. The first electrochemical cell and the second electrochemical cell may be coupled to form the electrochemical two-cell apparatus.

Another embodiment is a method including feeding carbon dioxide to a first cathode cavity of a first electrochemical cell of an electrochemical two-cell apparatus, and electrochemically reducing the carbon dioxide at a first cathode in the first electrochemical cell to CO, wherein electrochemically reducing the carbon dioxide generates $O^{-2}$ ions. The method includes flowing the CO from the first cathode cavity to a second cathode cavity of a second electrochemical cell of the electrochemical two-cell apparatus, and forming a product including at least one of ethanol or ethylene from the CO via a catalyst at a second cathode in the second electrochemical cell. The forming of the product may involve dimerization of the CO into CO dimer and hydrogenation of the CO dimer into the at least one of ethanol or ethylene. The method may include controlling an amount of the carbon dioxide fed to the first cathode cavity. The method may include discharging the product from the second cathode cavity. In implementations, the first cathode cavity and the second cathode cavity are separated by a partial barrier. In those implementations, the flowing of the CO from the first cathode cavity to the second cathode cavity may involve flowing the CO through an opening in the partial barrier. The first electrochemical cell and the second electrochemical cell share a housing of the electrochemical two-cell apparatus. The method may include diffusing the $O^{-2}$ ions through an electrolyte of the first electrochemical cell to an anode of the first electrochemical cell, forming $O_2$ gas from the $O^{-2}$ ions in an anode cavity of the first electrochemical cell, and discharging the $O_2$ gas from the anode cavity.

Yet another embodiment is a system including an electrochemical two-cell apparatus to electrochemically reduce carbon dioxide into CO at a first cathode and convert the CO into at least one of ethanol or ethylene at a second cathode. The electrochemical two-cell apparatus includes a first electrochemical cell including a first cathode cavity, the first cathode, a first catalyst disposed along the first cathode, a first anode, a first electrolyte to conduct $O^{-2}$ ions from the first cathode to the first anode, and a first anode cavity to collect and discharge $O_2$ gas formed from the $O^{-2}$ ions. The electrochemical apparatus includes a second electrochemical cell including a second cathode cavity to receive the CO from the first cathode cavity, the second cathode, a second catalyst disposed along the second cathode, a second anode to generate $H^+$ ions, a second anode cavity, a second electrolyte (proton conductor) disposed between the second anode and the second cathode to diffuse the $H^+$ ions from the second anode to the second cathode. In operation, the second catalyst may promote at the second cathode the dimerization of the CO into CO dimer and hydrogenation of the CO dimer via the $H^+$ ions into the at least one of ethanol or ethylene. The second catalyst may be, for example, Cu(100) catalyst that is copper having a facet cut of (100).

The system includes a first conduit to supply the carbon dioxide to the first cathode cavity, and a second conduit to discharge the at least one of ethanol or ethylene from the second cathode cavity. The system may include a control valve disposed along the first conduit to adjust an amount of the carbon dioxide supplied to the first cathode cavity. The electrochemical two-cell apparatus may include a barrier (e.g., partial barrier) dividing the first cathode cavity from the second cathode cavity and that allows for flow of the CO from the first cathode cavity to the second cathode cavity. The first electrochemical cell and the second electrochemical cell may share a housing of the electrochemical two-cell apparatus, and wherein the first cathode cavity and the second cathode cavity share a space in the housing. Included may be a partial barrier in the space that divides the space into the first cathode cavity and the second cathode cavity.

Yet another embodiment is an electrochemical two-cell apparatus including a first electrochemical cell including a first cathode cavity to receive carbon dioxide, a first cathode to electrochemically reduce the carbon dioxide into CO and generate $O^{-2}$ ions, a first anode to receive the $O^{-2}$ ions, a first anode cavity to collect and discharge $O_2$ gas formed from the $O^{-2}$ ions, a first electrolyte disposed between the first cathode and the first anode to conduct the $O^{-2}$ ions, and a first catalyst disposed along the first cathode. The electrochemical two-cell apparatus includes a second electrochemical cell including a second cathode cavity to receive the CO, a second cathode to convert the CO into at least one of ethanol or ethylene, a second anode to generate $H^+$ ions, a second anode cavity, a second electrolyte (e.g., proton conductor) to diffuse the $H^+$ ions from the second anode to the second cathode, and a second catalyst disposed along the second cathode. In operation, the second catalyst promotes at the second cathode the dimerization of the CO into CO dimer and hydrogenation of the CO dimer via the $H^+$ ions into the at least one of ethanol or ethylene. The first electrochemical cell and the second electrochemical cell may share a housing of the electrochemical two-cell apparatus. The first cathode cavity and the second cathode cavity may share a space in the housing. The electrochemical two-cell apparatus may include in a space a partial barrier that divides the first cathode cavity from the second cathode cavity and allows for flow of the CO from the first cathode cavity to the second cathode cavity.

A number of implementations have been described. Nevertheless, it will be understood that various modifications may be made without departing from the spirit and scope of the disclosure.

What is claimed is:

1. A method comprising:

feeding carbon dioxide to a first cathode cavity of a first electrochemical cell;

electrochemically reducing the carbon dioxide at a first cathode in the first electrochemical cell to carbon monoxide (CO);

flowing the CO from the first cathode cavity to a second cathode cavity of a second electrochemical cell, wherein the first electrochemical cell and the second electrochemical cell share a housing and are coupled to form an electrochemical two-cell apparatus, wherein the first cathode cavity and the second cathode cavity are separated by a partial barrier disposed in the housing and connected via a gap, thereby allowing for flow of the CO from the first cathode cavity to the second cathode cavity within the electrochemical two-cell apparatus through the gap, and wherein the gap is not part of the partial barrier; and forming at least one of ethanol or ethylene from the CO at a second cathode in the second electrochemical cell.

2. The method of claim 1, wherein forming the at least one of ethanol or ethylene from the CO comprises dimerization of the CO at the second cathode to form CO dimer.

3. The method of claim 2, wherein forming the at least one of ethanol or ethylene from the CO comprises hydrogenating the CO dimer at the second cathode.

4. The method of claim 3, wherein the hydrogenating comprises hydrogenating the CO dimer at the second cathode via hydrogen ions diffused through an electrolyte of the second electrochemical cell from an anode of the second electrochemical cell, the electrolyte comprising a proton conductor.

5. The method of claim 4, comprising:

feeding hydrogen gas or water to an anode cavity of the second electrochemical cell; and generating the hydrogen ions from the hydrogen gas or water at the anode.

6. The method of claim 3, wherein the dimerization and the hydrogenating are performed via an electrocatalyst at the second cathode.

7. The method of claim 6, wherein the electrocatalyst comprises Cu(100) catalyst that is copper having a facet cut of (100), and wherein the first electrochemical cell and the second electrochemical cell form an electrochemical two-cell apparatus.

8. The method of claim 1, wherein the partial barrier comprises a metal plate.

9. The method of claim 1, further comprising:

controlling an amount of the carbon dioxide fed to the first cathode cavity; and discharging the at least one of ethanol or ethylene from the second cathode cavity.

10. The method of claim 1, further comprising:

diffusing the oxygen ions through an electrolyte of the first electrochemical cell to an anode of the first electrochemical cell;

forming oxygen gas from the oxygen ions in an anode cavity of the first electrochemical cell; and discharging the oxygen gas from the anode cavity.

* * * * *